US009453305B2

(12) United States Patent
Imppola et al.

(10) Patent No.: US 9,453,305 B2
(45) Date of Patent: Sep. 27, 2016

(54) IN-LINE PRODUCTION METHOD FOR PAPER MAKING PROCESS

(71) Applicants: Stora Enso Oyj, Helsinki (FI); Wetend Technologies Ltd., Savonlinna (FI)

(72) Inventors: Olavi Imppola, Hyvinkaa (FI); Jouni Matula, Savonlinna (FI); Jussi Matula, Savonlinna (FI); Karri Tahkola, Savonlinna (FI); Isto Heiskanen, Imatra (FI); Matti Vakevainen, Imatra (FI); Jari Rasanen, Imatra (FI)

(73) Assignees: Stora Enso OYJ, Helsinki (FI); Wetend Technologies Ltd., Savonlinna (FI)

( * ) Notice: Subject to any disclaimer, the term of this patent is extended or adjusted under 35 U.S.C. 154(b) by 0 days.

(21) Appl. No.: 14/441,249

(22) PCT Filed: Nov. 6, 2013

(86) PCT No.: PCT/IB2013/059946

§ 371 (c)(1),
(2) Date: May 7, 2015

(87) PCT Pub. No.: WO2014/072914

PCT Pub. Date: May 15, 2014

(65) Prior Publication Data

US 2015/0292159 A1 Oct. 15, 2015

(30) Foreign Application Priority Data

Nov. 9, 2012 (SE) ..... 1251278

(51) Int. Cl.

| | |
|---|---|
| ***D21H 17/00*** | (2006.01) |
| ***D21H 11/18*** | (2006.01) |
| ***D21H 17/25*** | (2006.01) |
| ***D21H 17/67*** | (2006.01) |
| ***D21H 17/70*** | (2006.01) |
| ***D21H 17/28*** | (2006.01) |

(52) U.S. Cl.

CPC ..... *D21H 17/74* (2013.01); *D21H 11/18* (2013.01); *D21H 17/25* (2013.01); *D21H 17/28* (2013.01); *D21H 17/67* (2013.01); *D21H 17/675* (2013.01); *D21H 17/70* (2013.01)

(58) Field of Classification Search

CPC ..... D21H 17/00; D21H 17/28; D21H 17/25; D21H 17/67

USPC ..... 162/177

See application file for complete search history.

(56) References Cited

U.S. PATENT DOCUMENTS

| | | | |
|---|---|---|---|
| 5,731,080 | A | 3/1998 | Cousin et al. |
| 2005/0034827 | A1 | 2/2005 | Soderberg |
| 2011/0000633 | A1 | 1/2011 | Kukkamaki et al. |
| 2012/0080156 | A1 | 4/2012 | Laleg et al. |

FOREIGN PATENT DOCUMENTS

| | | |
|---|---|---|
| EP | 0935020 | 8/1999 |
| EP | 1219344 | 7/2002 |
| EP | 2287398 | 2/2011 |
| WO | 2005033403 | 4/2005 |
| WO | 2006008333 | 1/2006 |
| WO | 2010125247 | 11/2010 |
| WO | 2011042607 | 4/2011 |
| WO | 2011098672 | 8/2011 |
| WO | 2011110744 | 9/2011 |
| WO | 2011154610 | 12/2011 |
| WO | 2012039668 | 3/2012 |

OTHER PUBLICATIONS

Patent Cooperation Treaty, International-Type Search Report, ITS/SE12/00296, Jun. 4, 2013.

Miskiel, F J et al., "Use of High Amylose Corn Starch to Improve the Increase in Paper Strength Attained by Addition of Microfibrillated Cellulose," Research Disclosure, Dec. 1, 1999, 42806, Mason Publications, Hampshire, GB, ISSN 0374-4353, XP007125106.

International Searching Authority, International Search Report, PCT/IB2013/059946, Feb. 13, 2014.

International Searching Authority, Written Opinion of the International Searching Authority, PCT/IB2013/059946, Feb. 13, 2014.

European Patent Office, Extended European Search Report, PCT/IB2013/059946, May 3, 2016.

Office Action issued by the Pakistani Patent Office with regard to co-pending Pakistan Application No. 762/2013, dated Feb. 16, 2016.

Chinese Patent Office, First Office Action from corresponding Chinese Application 2013800698430, dated Jun. 12, 2016.

*Primary Examiner* — Mark Halpern

(74) *Attorney, Agent, or Firm* — Greer, Burns & Crain, Ltd.

(57) ABSTRACT

An in-line production method for providing a liquid flow of at least one additive in the short circulation and into the liquid flow of a paper making stock of a fiber web machine by feeding, the liquid flow of the at least one additive to the liquid flow of the short circulation, wherein a suitable amount of a microfibrillated cellulose or nanofibrillated polysaccharide is provided substantially simultaneously with the feeding of liquid flow of the at least one additive.

10 Claims, 3 Drawing Sheets

IN-LINE PRODUCTION METHOD FOR PAPER MAKING PROCESS

This application is a U.S. National Phase under 35 U.S.C. §371 of International Application No. PCT/IB2013/059946, filed Nov. 6, 2013, which claims priority under 35 U.S.C. §§119 and 365 to Swedish Application No. 1251278-6, filed Nov. 9, 2012.

TECHNICAL FIELD

The present document relates to a method for inline production method for a paper and paperboard making process, and for the simultaneous delivery of at least one additive and microfibrillated cellulose into the short circulation of a papermaking process. More particularly the present document relates to the crystallisation and precipitation of calcium carbonate in an inline production process.

BACKGROUND

Fillers are added to a papermaking pulp to fill void spaces not occupied with the fibres and thus to smoothen the surface of paper. They improve for example paper printability, dimensional stability, formation, and gloss. Added to this, optical paper properties like opacity, light scattering, and brightness are usually improved, because fillers' light scattering coefficient and brightness are often higher than those of pulp.

Fillers are low-priced when comparing to wood fibers and thus also used in a paper manufacture to reduce the costs of papermaking raw materials. Also drying of the filler-bearing paper web requires less energy. In spite of their inexpensive price and positive effects to paper properties, fillers have also negative features. They interfere inter-fiber bonding by adsorption or precipitating on fiber surfaces. Because of this, paper tensile strength and tensile stiffness are reduced and in printing there can appear linting. Also abrasion on paper machine can increase because of fillers. Their retention is quite poor too and can cause two-sidedness on paper.

In packaging board grades, fillers are not typically used or used in a very low amounts compared to other paper grades. Typical reasons for this are that they increase weight of the board without giving strength properties and that they reduce calibre in the same grammage. Calibre is most important parameter for bending stiffness. Also the fillers reduce elastic modulus, which is an important parameter for bending stiffness.

Bleached pulp is quite often used in the top ply of the board. Target with this is to have higher brightness and generally improved appearance of the board. Even on such cases only very low filler amounts are used and typically quite expensive fillers, such as TiO2, calcined kaolin, etc., are used to optimize elastic modulus of the top ply and maximize board bending stiffness. Quite often top ply grammage is optimized against whiteness and brightness and visual appearance instead of optimizing it against maximal bending stiffness.

Thus there would be a high need to improve whiteness and opacity of the board top ply while maintaining board bending stiffness and at the same time use low cost fillers.

One quite typical filler used in paper making is precipitated calcium carbonate (PCC). Typically the production of PCC has been produced separately from the actual papermaking process. PCC is normally produced at a dedicated plant located close the paper mill.

In WO 2011110744 A1 a method and a reactor for in-line production of calcium carbonate (PCC) in connection with the production process of a fibrous web is disclosed. This relates to in-line production of PCC into a suspension to be used in the production of the fibrous web, especially preferably directly into the flow of fibrous pulp, one of its partial pulp flows or a filtrate flow used in the production of fibrous pulp. This method has several advantages as reduced investment costs, since there is no need to have a separate PCC plant. Further there is a reduced need of retention chemicals as PCC is at least partially precipitated directly onto fibres.

In EP2287398A1 a method for obtaining a calcium carbonate, possibly fibers and fiber-fibril containing composite is obtained in which the calcium carbonate particles, if needed with the fibrils and fibers are connected, which is characterized by good dewatering capability and which for the manufacture of paper with a large amount of filler, with a great strength and having a large specific volume. This invention is achieved by the combination of five measures, the use of specific calcium carbonate particles, which is ($d_{50}$) and has a scalenohedral morphology and an average particle diameter of more than 2.5 μm and a maximum of 4 μm micrometers, by the setting of a weight ratio of fibrils to calcium carbonate particles in the suspension before the coprecipitation of 0.2:1 to 4:1, by the use of fiber-fibrils and trough the setting of a weight ratio of calcium ions into the fibrils before the coprecipitation of 0.02:1 to 0.2:1. However this method describes a traditional off-line precipitated calcium carbonate using carbon dioxide and lime milk process with fibers.

There is thus a need for a new process for the production of a board ply having a desirable visual appearance, but also an optimized elastic modulus.

SUMMARY

It is an object of the present disclosure, to provide an improved method for feeding additives into the short circulation of a fibrous web forming machine. The said web can also be part of a ply in a multiply paper or paperboard structure. The fed additives can also be regarded as a separate layer that forms a multilayer paper structure as disclosed in e.g. publication US2005034827.

A specific object of the present disclosure is to provide an improved method of inline precipitation of calcium carbonate into the short circulation.

The object is wholly or partially achieved by a method according to the appended independent claim. Embodiments are set forth in the appended dependent claims, and in the following description and drawings.

According to a first aspect there is provided an in-line production method for providing a liquid flow of at least one additive in the short circulation and into the liquid flow of a paper making stock of a fiber web machine by feeding, the liquid flow of the at least one additive to the liquid flow of the short circulation, when there are two or more additives, the method further comprises allowing these to react with one another, wherein the method comprises crystallizing a filler, and wherein the additives are carbon dioxide and lime milk, said carbon dioxide and lime milk being fed to the short circulation, wherein a suitable amount of a microfibrillated cellulose or nanofibrillated polysaccharide is provided substantially simultaneously with the feeding of liquid flow of the two additives, such that the additives reacts or start nucleation onto the surface of cellulose or precipitate on the surface of the microfibrillated cellulose and thereby form complexes with the microfibrillated cellulose or nanofibrillated polysaccharide.

By "additive" is meant a reactive additive which reacts before wet pressing of the web or in short circulation, such that the product of the additive in this particular inventive method be may be a filler material or filler-fiber composite material.

By this inline production method there is provided a way of feeding additives, such as lime milk and carbon dioxide, to the short circulation, which may be mixed with the microfibrillated cellulose (MFC), such that the advantageous effects of this mixture may be obtained thereby. The additives may for instance react or start nucleation onto the surface of cellulose or precipitate on the surface of the microfibrillated cellulose and thereby form complexes with the MFC having properties that are improved or altered compared to the additives simply being fed to the short circulation without the MFC addition or if the additives are reacted before MFC is present.

It may thus be possible to e.g. "glue" the MFC fibers together also with different types of additives that precipitate in the wet end of the papermaking process, such as for instance dissolved cellulose.

By this method there is provided an "in-line production" of the precipitated calcium carbonate (FCC) thus being produced directly into the short circulation of the paper machine. Such methods are described in for instance US2011000633 and WO2011/110744.

The use of MFC or so called nanocellulose has been studied in paper making quite widely. It has been found out that even though MFC improves strength properties (including elastic modulus, which is important for board top ply), it reduced porosity and increased drying shrinkage at the same time. These, however, have negative effects on e.g. board making and the paperboard properties in that the top ply porosity is reduced due to MFC, which leads to a risk of blowing. Drying of a ply with low porosity will form steam inside of the board and as this steam cannot escape fast enough the board is delaminated. Also the MCF increases drying shrinkage, small scale drying will increase surface roughness of the board and lead to poor print quality. It is further known that in-line PCC process will provide a clean paper machine system, since there is much less need (or clearly reduced need) of retention chemicals.

By combining an in-line PCC process with the provision or dosing of microfibrillated cellulose MFC several improvements in, for instance, top ply applications have been observed.

There is an increased whiteness of board and also decrease cloudiness of white surface and an increase of the board smoothness.

There is an increase elastic modulus in the same porosity and improved whiteness.

By using in-line PCC, there are reduced costs for process chemicals, and increased board machine process purity, seen as less web brakes, less dirty spots, no accumulations on pipelines.

It has surprisingly been found that precipitation of the PCC particles happens more preferably on the surface of fine particles that exists in the process waters, which is also related to the high surface area, higher surface energy and pH properties of these fine particles.

By "suitable amount of MFC" is meant an amount that is sufficient for the interaction with lime milk and further precipitation of an effective amount of PCC onto or into the MFC. This may vary depending on the final product of the paper making stock, but as an example, the MFC dosage may be in a range of 5-50 kg/ton of a top ply for a board and PCC in a range of 1-20% (10-200 kg/ton) of the top ply, depending on the origin of the paper making stock and the desired characteristics of the top ply.

By providing the microfibrillated cellulose or "nanocellulose" (MFC) substantially simultaneously as the lime milk in the in-line reactor for further reaction with carbon dioxide which corresponds to the disclosed method of producing the MFC-PCC material and hence the amount of fines needed to obtain a satisfactory whiteness and visual appearance while still being able to control the drying shrinkage and maintain the improvement in elastic modulus may be easily controlled, in that the larger part of the calcium carbonate is precipitated onto the MFC particles or into the MFC solution.

Thus, by introducing, or dosing, MFC into an in-line PCC process there is provided a way to control the amount of fines needed, as the surface pH and chemistry of the MFC can be adjusted, and thus, the particle size and dimensions of the PCC that is introduced into the short circulation or liquid stock fiber flow may be controlled.

Also by having the PCC particles onto the MFC surface, the porosity of the board may be controlled, the drying shrinkage can be controlled and the improved elastic modulus provided by the MFC may be maintained. By having the PCC particles on the top ply of the board the board whiteness and printability may be improved without reduced bending stiffness.

Since in-line PCC is a relatively cheap filler the costs of the board may be reduced, in relation to using more expensive fillers for obtaining the optical properties.

There is also an increased cleanliness of the board making machine.

According to one embodiment, the feeding into the short circulation may be performed by injecting at least one additive and/or microfibrillated cellulose into the liquid flow of the paper making stock. The feeding into the short circulation may be performed by injecting at least either carbon dioxide, lime milk and/or microfibrillated cellulose into the liquid flow of the paper making stock.

According to one alternative embodiment the carbon dioxide, lime milk and/or microfibrillated cellulose may be fed separately by injection.

Thus by "the MFC being provided substantially simultaneously" is meant that the carbon dioxide, lime milk and MFC are fed at the same time and in the proximity of each other into the liquid flow.

According to an alternative embodiment the microfibrillated cellulose may be provided in the liquid flow of a paper making stock and the lime milk and carbon dioxide may be fed separately or simultaneously by injection.

Thus by "provided substantially simultaneously" is here meant that the MFC is present in the liquid flow and that the lime milk and carbon dioxide are released either simultaneously or separately (and in the proximity of each other).

According to yet an alternative embodiment the lime milk and microfibrillated cellulose may be mixed prior to the injection into the liquid flow of a paper making stock and the carbon dioxide may be fed separately from the lime milk and microfibrillated cellulose mixture.

Thus be "provided substantially simultaneously" is meant that the lime and MFC are mixed before feeding into the liquid flow of paper making stock and that the carbon dioxide is fed separately but in the proximity of the mixture.

According to yet another embodiment the microfibrillated cellulose may be mixed with other optional additives and this mixture may be fed separately from the feeding of lime and carbon dioxide.

The injection into the liquid flow of a paper making stock may be performed from one more several nozzles in a direction substantially transverse to the direction of the liquid flow, and at a flow rate that is higher than that of the liquid flow.

This rapid precipitation reaction, or fast addition and further reaction of lime milk and carbon dioxide in the liquid flow stock provides an easy way of precipitating PCC, as the crystals, i.e. the precipitation of calcium carbonate on the MFC may be formed very quickly. This may provide for the formation of new types of filler-fiber complexes in which the PCC forms new types of crystals on the surface of the MFC.

The liquid flow of paper making stock may comprise at least one of the following components: virgin pulp suspension (long-fiber pulp, short-fiber pulp, mechanical pulp, chemomechanical pulp, chemical pulp, microfiber pulp, nanofiber pulp), recycled pulp suspension (recycled pulp, reject, fiber fraction from the fiber recovery filter), cellulose whiskers, regenerated cellulose fibers, dissolving pulp, additive suspension and solids-containing filtrate.

According to an alternative embodiment the fibrous web may also be formed into a foam, i.e. a substance that is formed by trapping pockets of gas in a liquid or solid, and not only be in a liquid or aqueous form.

BRIEF DESCRIPTION OF THE DRAWINGS

Embodiments of the present solution will now be described, by way of example, with reference to the accompanying schematic drawings in which.

DESCRIPTION OF EMBODIMENTS

Definition of Nanofibrillated Polysaccharide

Figure 1:
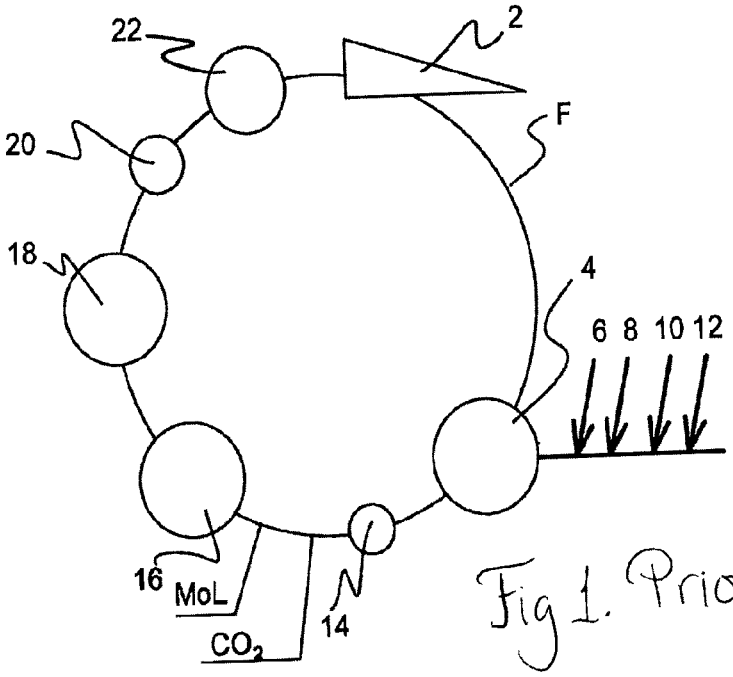
Fig 1. Prior Art
FIG. 1 shows schematically a short circulation arrangement according to prior art.

This definition includes bacterial cellulose or nanocellulose spun with either traditional spinning techniques or with electrostatic spinning. The fibers can also be formed by other means using e.g. ionic liquids or membrane techniques (precipitation or coagulation of dissolved cellulose) and thus either a form of regenerated cellulose or liberated fibrils obtained by selective dissolving liquids. In these cases, the material is preferably a polysaccharide but not limited to solely a polysaccharide.

Also microcrystalline cellulose, whiskers and nanocellulose crystals is included in this definition. The said component can also be a mixture of the presented materials or combination between organic and synthetic nanofibers.

Definition of Microfibrillated Cellulose

The microfibrillated cellulose (MFC) is also known as nanocellulose. It is a material typically made from wood cellulose fibers, both from hardwood or softwood fibers. It can also be made from microbial sources, agricultural fibers such as wheat straw pulp, bamboo or other non-wood fiber sources. In microfibrillated cellulose the individual microfibrils have been partly or totally detached from each other. A microfibrillated cellulose fibril is normally very thin (~20 nm) and the length is often between 100 nm to 10 μm. However, the microfibrils may also be longer, for example between 10-200 μm, but lengths even 2000 μm can be found due to wide length distribution. Fibers that has been fibrillated and which have microfibrils on the surface and microfibrils that are separated and located in a water phase of a slurry are included in the definition MFC. Furthermore, whiskers are also included in the definition MFC.

MFC or nanocellulose or nanocrystalline cellulose can be made with different means such as mechanically or chemically or enzymically or by using bacteria or by combining e.g. chemical and mechanical treatment steps.

Different types of spinning and precipitation processes can also be used. In this case, the starting material for making a nanofiber or MFC can be a polysaccharide.

Even though it is known that microfibrillated cellulose (MFC) increase elastic modulus of paper, microfibrillated cellulose (MFC) is not good for top ply of board due to reduced porosity (poor porosity/elastic modulus ratio) and increased drying shrinkage.

However there is a need to increase whiteness of board grades, but this has not been possible previously efficiently with fillers due to reduction of elastic modulus. In duplex type boards (3 ply board with brown middle ply) this is done mainly with top ply grammage increase (and 3% filler).

Description of Precipitated Calcium Carbonate (PCC)

Almost all PCC is made by direct carbonation of hydrated lime, known as the milk of lime process. Calcium oxide (CaO) is mixed with water forming the slaked lime or lime milk or hydrated lime. The lime of milk, also denoted lime milk in this application, and carbon dioxide, is mixed and allowed to react in order to form the precipitated calcium carbonate (PCC). The PCC may then be used as filler in paper and paperboard, speciality paper such as cigarette papers, laminating papers, etc. The PCC can also be used in surface sizing of paper or paperboards, or as a pigment in mineral coating or in barriers. The said PCC can also be used as a filler in plastics.

Within the definition of a precipitated calcium carbonate, is also included the possibility to include other metal (II) oxides that are mixed into water such as Mg(OH)2.

Definition of In-line Precipitated Calcium Carbonate Process

By "in-line production" is meant that the precipitated calcium carbonate (PCC) is produced directly into the flow of the paper making stock, i.e. the captured carbon dioxide is combined with slaked lime milk inline, instead of being produced separately from the paper making process. Separate production of PCC further requires the use of retention materials to have the PCC fastened to the fibers. An in-line PCC process is generally recognized as providing a cleaner paper machine system, and a there is a reduced need of retention chemicals. An in-line PCC process is for instance disclosed in WO2011/110744.

FIG. 1 shows a prior art method for inline production of precipitated calcium carbonate, as disclosed in US2011/0000633 and a schematic process arrangement for a paper making machine 2. The white water F, is carried to e.g. a mixing tank or filtrate tank 4, to which various fibrous components are introduced for the paper making stock preparation. From fittings at least one of virgin pulp suspension (long-fiber pulp, short-fiber pulp, mechanical pulp, chemomechanical pulp, chemical pulp, microfiber pulp, nanofiber pulp), recycled pulp suspension (recycled pulp, reject, fiber fraction from the fiber recovery filter), regenerated cellulose, dissolving pulp, additive suspension and solids-containing filtrate is carried to the mixing tank, and from there conveyed by a mixing pump 14 to a vortex cleaner 16, where heavier particles are separated. The accept of the vortex cleaning continues to a gas separation tank 18, where air and/or other gases are removed from the paper making stock. The paper making stock is then transported to a feed pump 20 of the headbox, which pumps the paper making stock to a so-called headbox screen 22, where large sized particles are separated from the paper making stock. The accept faction is carried to the paper making machine 2 through its headbox. The short circulation of fiber web machines producing less demanding end products may, however, not have a vortex cleaner, gas separation plant and/or headbox.

In the prior art process the PCC production is performed in the short circulation of the paper making machine, before the vortex cleaning plant 16. The carbon dioxide ($CO_2$) is injected on the pressure side of the vortex cleaner and the lime milk (MoL) is injected a few meters after the carbon dioxide has dissolved in the same pipe. It is however conceivable that this PCC production could take place closer to the headbox, or that the distance between the injectors is very small, virtually injecting carbon dioxide and lime milk at the same location in the short circulation. This depends on the requirements of the end product and the design of the paper making machine.

According to the invention there is provided an inline production method where additives, such as carbon dioxide, milk lime etc., are fed into the short circulation of the paper making machine, i.e. into the fibrous web or paper making stock, and where a suitable amount of a microfibrillated cellulose, MFC, is provided substantially simultaneously as these additives are being fed into the short circulation.

What is meant by "substantially simultaneously" may vary as described below, however in this context it is to be understood that the MFC is provided such that the additive, such as e.g. PCC may be formed, i.e. crystallized onto or into the MFC.

Where two or more additives are fed into the short circulation these are preferably allowed to react with one another, which means that they are fed into the short circulation in a manner which allows for the additives to react, in the case of lime milk and carbon dioxide, such that precipitated calcium carbonate is formed onto or into the MFC.

According to one embodiment of the present invention, an in-line PCC process is combined with the dosage of MFC into the in-line PCC process. This provides for a completely new way of providing PCC to for instance a fibrous web in a paper making process.

Figure 2:
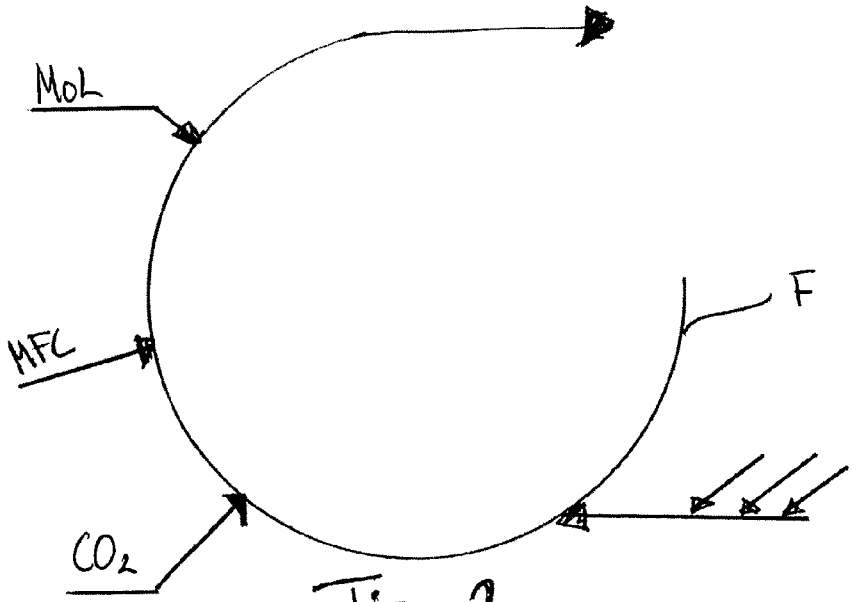
FIG. 2 shows schematically a short circulation arrangement according to one embodiment of the invention.

In one embodiment of the present invention, as shown in FIG. 2 lime milk, carbon dioxide and MFC are injected separately into the short circulation and fibrous web of the paper making machine.

Figure 3B:
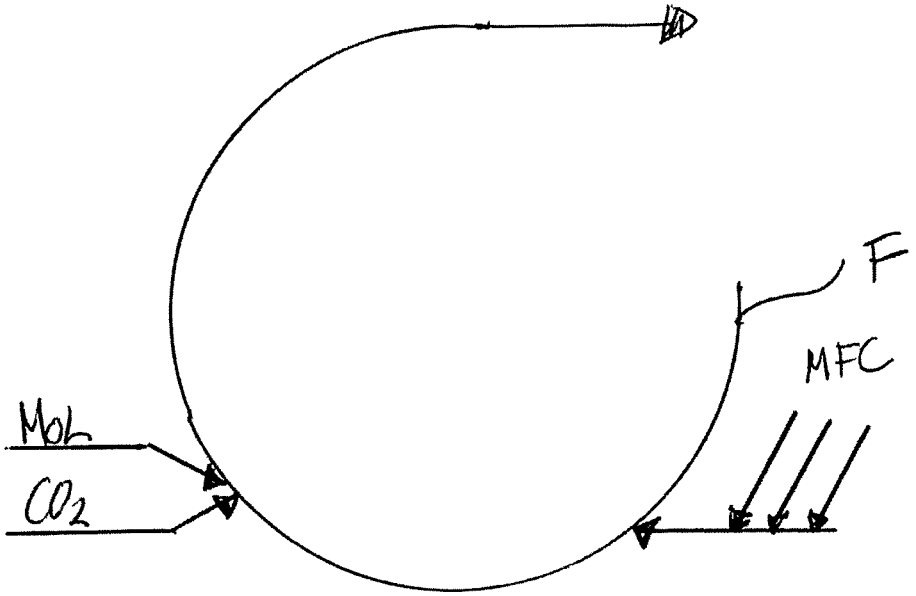
FIGS. 3*a-b* shows schematically a short circulation arrangement according to one alternative embodiment of the invention.
Figure 3A:
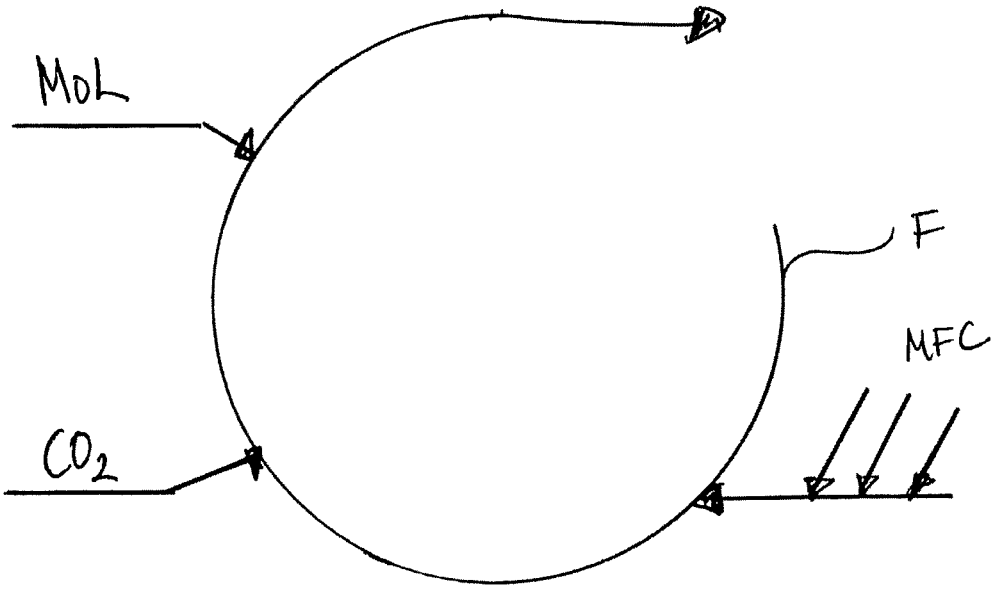

In an alternative embodiment, as shown in FIGS. 3*a* and 3*b* the MFC is provided e.g. in the preparation of the paper making stock, and thus is present in the paper making stock and the carbon dioxide and lime milk are injected separately (FIG. 3*a*) or simultaneously (FIG. 3*b*) into the short circulation.

Figure 4:
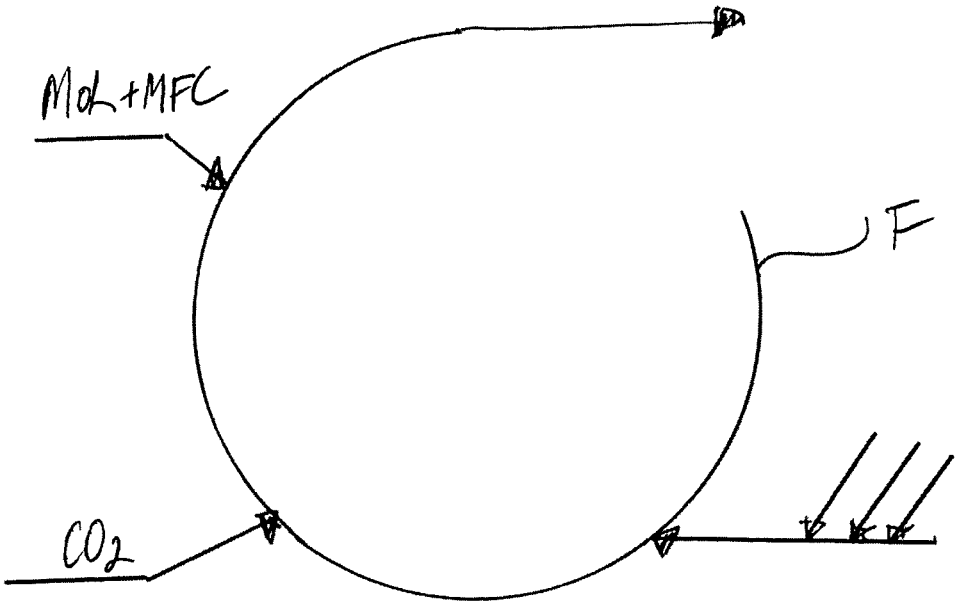
FIG. 4 shows schematically a short circulation arrangement according to yet an alternative embodiment of the invention.

In yet an alternative embodiment, as shown in FIG. 4 the lime milk and the MFC are mixed before the injection into the short circulation and the carbon dioxide is injected separately from this mixture.

Figure 5:
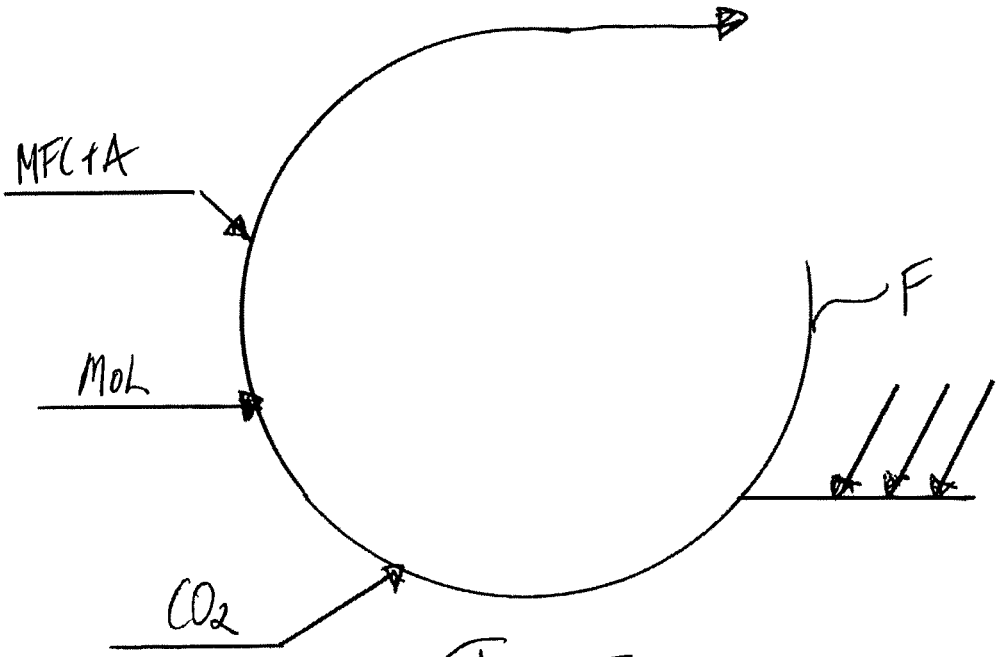
FIG. 5 shows schematically a short circulation arrangement according to yet another alternative embodiment of the invention

In yet another alternative embodiment, as shown in FIG. 5, the MFC is mixed with other additives and this mixture is injected separately from the lime milk and carbon dioxide.

In all of the above described embodiments it is to be understood that the order of injection of the additives, i.e. lime milk, carbon dioxide, MFC and possibly other additives may occur in a different order or at a different stage in the short circulation. It is conceivable that the injection occurs very close to the headbox, or that the MFC dosage is prior to the addition of the carbon dioxide or that the distances between the "injection points" is shorter or longer than described above. Thus the MFC, lime milk and carbon dioxide may be injected into the short circulation substantially at the same injection point.

The point or point where the injection takes place thus forms a "PCC reaction zone".

According to one embodiment the MFC provides for an increased fiber surface area onto which the PCC may precipitate or onto which lime milk can react providing more efficient precipitation of calcium carbonate.

By modifying and adjusting the surface energy, surface pH and surface chemistry of the MFC there is provided a completely new way of controlling how the PCC crystals are formed on the surface of the MFC. The crystals formed on the surface of the MFC particle may take on different shapes and configurations.

By combining the in-line PCC process with a dosing or introduction of MFC there is provided a new way of controlling the paper making process without, e.g. modifying the entire white water circulation.

Further in the application of the fibrous web forming a top ply, several improvements have been observed, such as an increased whiteness of board and also decrease cloudiness of white surface and an increase of the board smoothness. There is also an increase elastic modulus in the same porosity and improved whiteness.

By using PCC there are reduced costs for process chemicals, and increased board machine process purity, such as less web brakes, less dirty spots, no accumulations on pipelines.

In EP1219344 B1, a method and apparatus which are particularly well applicable to homogeneous adding of a liquid chemical into a liquid flow are disclosed. In this method a mixer nozzle is utilized, and the liquid chemical is fed into the mixer nozzle and a second liquid is introduced into the same mixer nozzle, such that the chemical and second liquid are brought into communication with each other substantially at the same time as the chemical is discharged together with the second liquid from the mixer nozzle at high speed into the process liquid, and transverse to the process liquid flow in the flow channel. The chemical and second liquid may be discharged directly into the fiber suspension flowing towards the headbox of the paper machine. The second liquid may be a circulation liquid from the paper process, such as white water, or may be fresh water depending on the requirements of the liquid chemical to be added to the fiber flow. The flow speed from the mixer nozzle may be around five times the flow speed of the fiber suspension into which the chemical and second liquid is discharged.

By using this type of fast addition of the lime milk and MFC there is provided a way of forming the FCC crystals on the MFC very quickly. This fast formation of the FCC crystals provides for new PCC-fiber complexes in which the PCC grows in a cubic formation around the strings and wires of the MFC. This provides for less steric hindrance and provides great strength for the structure. A further advantage of this new crystal formation is that it provides for a very clean process without any up-build of FCC in pipes etc.

Also as the PCC is formed around the MFC or nanocellulose, and is bound very tightly to the fibre the hazards of using such small particles as the MFC is greatly reduced. This can be seen as reduced dusting (in the paper machine drying section, in printing, cutting etc.) tendency especially when high PCC amounts are used.

According to an alternative, the MFC may be surface modified or mixed with other additives as well before or during feeding. Those additives may be CMC, starch, A-PAM, OBA, calcium chloride, PAC, and other papermaking chemicals tested for wet end applications.

In EX1 mixing of MFC and starch to the milk of lime was done and that was dosage or introduced into the in-line PCC reactor, where $CO_2$ was also introduced for the formation of precipitated calcium carbonate, PCC directly into the short circulation.

In EX2 the MFC and starch were dosage to the mixing chest (thick stock) were only birch fibers are present and an in-line PCC reactor was used as it normally used (pure milk of lime was dosaged without any additives).

As a reference (REF1) an off-line PCC was used, which was produced and transported from a paper mill for these pilot trials. In REF2 (and EX1 and EX2) "in-line PCC" referrers to the PCC reactor, i.e. in the short circulation of the paper machine, into which pulp and white water goes just before centrifugal cleaners, but in REF2 no MFC was added.

TABLE 1

Overview of trials

| | | REF1 | REF2 | EX1 | EX2 |
|---|---|---|---|---|---|
| | | Off-line PCC | | | |
| Filler level in end product | | 5% | 7.50% | 7.50% | 7.50% |
| dosing place | | level box | PCC reactor | PCC reactor | PCC reactor |
| filler type | | PCC | Inline-PCC | Inline-PCC | Inline-PCC |
| CMC mixed to milk of lime and then cationic starch with T-bar when pumped | | | | | |
| CMC amount from filler (2.3 kg/t from paper) | | | | 3% | |
| starch amount from filler (2.3 kg/t from paper) | | | | 3% | |
| MFC to the milk of lime 2.3 kg/t of the end product (paper) | | | | | |
| MFC-amount from filler | | | | 3% | |
| Cationic starch | Mixing chest | | | | 20 kg/t |
| MFC | Mixing chest | | | | 20 kg/t |
| Grammage | g/m2 | 66.8 | 65.7 | 65.3 | 64.2 |
| Density | kg/m3 | 726 | 747 | 759 | 773 |
| Bulk | | 1.38 | 1.34 | 1.32 | 1.29 |
| Air resistance Gurley | s/100 ml | 11 | 11 | 15 | 31 |
| Brightness D65/10° +UV, bs | | 85 | 85.3 | 84.7 | 84.8 |
| Opacity C/2° +UV | % | 78.4 | 79.8 | 78.1 | 77.5 |
| Tensile stiffness index, geom | | 5.6 | 5.3 | 5.9 | 6.3 |
| Tensile index geom. | | 51.4 | 45.9 | 54.2 | 58.8 |
| Burst index | | 3.1 | 2.6 | 3.4 | 3.8 |
| E-modulus, geom | | 4051 | 3942 | 4495 | 4870 |

EXAMPLE

A trial was performed in a pilot paper machine. Target of the trial was to simulate top ply of multi ply board.

Furnish was 100% bleached birch refined to 26 SR level. Running speed was 80 m/min and grammage 65 gsm. Conventional paper making chemicals used in board production were used, such as retention chemicals, hydrophobic sizing etc. These parameters were kept the same during the trial.

Table 1 below shows an overview of how the trials were performed and the chemicals used therein.

The addition of CMC (carboxymethyl cellulose) is not essential, however a slight improvement in strength could be noticed. CMC does however have negative effect on wire retention and brightness.

Starch is typically added as it gives some strength without major negative effects.

From these trials is clear that it is not possible to replace the 5% off-line PCC with 7.5% in-line PCC because strength values goes down too much with regards to tensile strength, burst index etc.

It is possible to replace 5% off-line PCC with 7.5% in-line PCC if an addition of 2.3 kg/t of MFC and starch with milk of lime is performed according to the invention (EX1). The MFC and starch dosage levels are very low 2.3 kg/t, which means that based on these dosages the costs can be kept low, while still getting very big improvements in strength properties of the ply.

For board top ply the porosity must be kept high (in order to make possible to dry the board fast) and in this way (mixing MFC and milk of lime) one can keep MFC amount low a keep high porosity level.

EX2 shows that if MFC and starch instead are dosaged into the thick stock much higher amounts are needed for the same strength levels and the high porosity is lost. The Gurley hill porosity of 31 s/100 ml shows a low porosity of this paper ply.

The invention claimed is:

1. An in-line production method for providing a liquid flow of two or more additives in a liquid flow of a short circulation and into a liquid flow of a paper making stock of a fiber web machine by feeding the liquid flow of the additives to the liquid flow of the short circulation, wherein the method further comprises allowing the two or more additives to react with one another, wherein the method comprises crystallizing a filler, and wherein the additives are carbon dioxide and lime milk, said carbon dioxide and lime milk being fed to the short circulation wherein a suitable amount of a microfibrillated cellulose or nanofibrillated polysaccharide is provided substantially simultaneously with the feeding of the liquid flow of the at least two additives, such that the additives reacts or start nucleation onto the surface of cellulose or precipitate on the surface of the microfibrillated cellulose and thereby form complexes with the microfibrillated cellulose or nanofibrillated polysaccharide.

2. The method as claimed in claim 1, wherein the feeding into the short circulation and into the liquid flow of a paper making stock is performed by injecting the two or more additives and/or the microfibrillated cellulose into the liquid flow of the paper making stock.

3. The method as claimed in claim 1, wherein the feeding into the short circulation and into the liquid flow of a paper making stock is performed by injecting at least one of the carbon dioxide, lime milk and microfibrillated cellulose into the liquid flow of the paper making stock.

4. The method as claimed in claim 1, wherein one or more of the carbon dioxide, lime milk and microfibrillated cellulose are fed separately by injection.

5. The method as claimed in claim 1, wherein the microfibrillated cellulose is provided in the liquid flow of a paper making stock and the lime milk and carbon dioxide are fed separately or simultaneously by injection.

6. The method as claimed in claim 1, wherein lime milk and microfibrillated cellulose are mixed prior to the injection into the liquid flow of a paper making stock and the carbon dioxide is fed separately from the lime milk and microfibrillated cellulose mixture.

7. The method as claimed in claim 1, wherein the microfibrillated cellulose is mixed with other optional additives and the mixture is fed separately from the feeding of lime and carbon dioxide.

8. The method as claimed in claim 1, wherein the injection into the liquid flow of a paper making stock is performed from one or several nozzles in a direction substantially transverse to the direction of the liquid flow of a paper making stock, and at a flow rate that is higher than that of the liquid flow of a paper making stock.

9. The method as claimed in claim 1, wherein the liquid flow of paper making stock comprises at least one of the following components: virgin pulp suspension, recycled pulp suspension, additive suspension and solids-containing filtrate.

10. An in-line production method for providing a liquid flow of two or more additives in a liquid flow of a short circulation and into a liquid flow of a paper making stock of a fiber web machine comprising:

feeding carbon dioxide into the liquid flow of the short circulation of the paper making stock of the fiber web machine;

feeding lime milk into the liquid flow of the short circulation;

providing a suitable amount of a microfibrillated cellulose, a nanofibrillated polysaccharide, or a mixture thereof into the liquid flow of the short circulation substantially simultaneously with the feeding of the carbon dioxide and the feeding of the lime milk such that the carbon dioxide and lime milk begin to crystalize onto the microfibrillated cellulose, the nanofibrillated polysaccharide or the mixture thereof, into the microfibrillated cellulose, the nanofibrillated polysaccharide or the mixture thereof, or both.

* * * * *